US006017021A

United States Patent [19]

Yiu

[11] Patent Number: 6,017,021

[45] Date of Patent: Jan. 25, 2000

[54] LIQUID AERATING ASSEMBLY HAVING A SAFETY DEVICE

[76] Inventor: Chih-Hao Yiu, 7F-1, No. 30, Lin Sen Road, Taichung City, Taiwan

[21] Appl. No.: 09/001,839

[22] Filed: Dec. 31, 1997

[51] Int. Cl.[7] ..... B01F 3/04

[52] U.S. Cl. ..... 261/64.1; 261/119.1; 261/DIG. 7

[58] Field of Search ..... 261/64.1, 65, 119.1, 261/DIG. 7; 99/323.1; 426/477

[56] References Cited

U.S. PATENT DOCUMENTS

| | | | |
|---|---|---|---|
| 4,298,551 | 11/1981 | Adolfsson et al. | 261/DIG. 7 |
| 4,304,741 | 12/1981 | Avison et al. | 99/323.1 X |
| 4,395,940 | 8/1983 | Child et al. | 99/323.1 |
| 4,399,081 | 8/1983 | Mabb | 261/DIG. 7 |
| 4,401,016 | 8/1983 | Adams et al. | 99/323.1 |
| 4,982,876 | 1/1991 | Scott | 261/DIG. 7 |

FOREIGN PATENT DOCUMENTS

| | | | |
|---|---|---|---|
| 2133302 | 7/1984 | United Kingdom | 261/DIG. 7 |

*Primary Examiner*—Richard L. Chiesa
*Attorney, Agent, or Firm*—Charles E. Baxley, Esq.

[57] ABSTRACT

A liquid aerating assembly includes a housing and a container engaged in the housing. A ring is engaged on the mouth of the container for securing the container to the housing. A supplying mechanism may supply the pressurized gas into the container. A knob is slidably engaged in the housing for actuating the supplying mechanism to supply the gas into the container. The ring includes an arm for engaging with the supplying mechanism and for disabling the supplying mechanism before the container is secured in place. A stop is engaged with a pawl for allowing the pressurized gas to be supplied into the container for a short interval once at a time. A pressure relief valve may be used for relieving the pressure built in the container before the container is removed from the housing.

4 Claims, 9 Drawing Sheets

LIQUID AERATING ASSEMBLY HAVING A SAFETY DEVICE

BACKGROUND OF THE INVENTION

1. Field of the Invention

The present invention relates to a liquid aerating assembly, and more particularly to a liquid aerating assembly having a safety device.

2. Description of the Prior Art

Typically, the aerated beverages are prepared by the factories and manufacturers. However, once the container for the aerated beverage is opened, the gas, particularly the carbon dioxide will be disengaged from the liquid. The users may not aerate the liquid manually and may not make the aerated beverage by themselves. In addition, the aerated beverages are largely contained in plastic bottles which will be discarded after use. The plastic bottles may seriously pollute our environment.

The present invention has arisen to mitigate and/or obviate the afore-described disadvantages of the conventional aerated beverages.

SUMMARY OF THE INVENTION

The primary objective of the present invention is to provide a liquid aerating assembly which includes a safety device for preventing the liquid container from being over pressurized and from explosion.

In accordance with one aspect of the invention, there is provided a liquid aerating assembly comprising a housing including a chamber, a container engaged in the chamber of the housing and including a mouth, a ring engaged on the mouth of the container for securing the container to the housing, and means for supplying pressurized gas into the container.

The mouth of the container includes an outer peripheral portion having at least one protrusion extended outward, the ring includes at least one notch for engaging with the at least one projection. The housing includes a plate having a cylindrical member extended downward for engaging between the mouth and the ring, the cylindrical member includes at least one channel for engaging with the at least one protrusion for securing the container and the ring to the housing. The ring includes at least one frame for engaging with the at least one protrusion and the at least one channel and for securing the container to the housing.

The ring includes an arm extended radially outward for engaging with the pressurized gas supplying means and for disabling the pressurized gas supplying means before the container and the ring are secured to the housing.

In accordance with another aspect of the invention, there is provided a liquid aerating assembly comprising a housing including a chamber, a container engaged in the chamber of the housing and including a mouth, means for supplying pressurized gas into the mouth of the container, and means for actuating the pressurized gas supplying means to supply the pressurized gas for a short interval once at a time.

The housing includes a knob slidably engaged therein, and includes a pawl rotatably secured to the knob, and includes means for positioning the pawl and for allowing the pawl to actuate the pressurized gas supplying means when the knob is depressed. The knob includes a stop rotatably secured to the knob and includes means for biasing the stop to engage with the pawl. The knob includes means for disengaging the stop from the pawl. The housing includes means for preventing the knob from being actuated before the container is secured in place. The knob includes an extension having a slot, the housing includes a guide slidably engaged in the slot for limiting a movement of the knob relative to the housing.

In accordance with a further aspect of the invention, there is provided a liquid aerating assembly comprising a housing including a chamber, a container engaged in the chamber of the housing and including a mouth, means for supplying pressurized gas into the mouth of the container, a pressure relief valve coupled to the mouth for relieving a pressure in the container, and means for actuating the pressure relief valve to relieve the pressure in the container.

The actuating means includes a handle pivotally coupled to the housing, the handle includes an actuator for actuating the pressure relief valve and includes a leg, and a retainer is secured in the housing for engaging with the leg of the handle and for disengaging the actuator from the pressure relief valve. The retainer includes a head for engaging with the leg and for disengaging the actuator from the pressure relief valve. A ring is engaged on the mouth of the container for securign the mouth to the housing, the ring has a projection extended radially outward for engaging with the retainer, the leg may engage with the retainer after the projection of the ring is engaged with the retainer. The leg includes a jut for engaging with the projection and for preventing the ring from being disengaged from the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
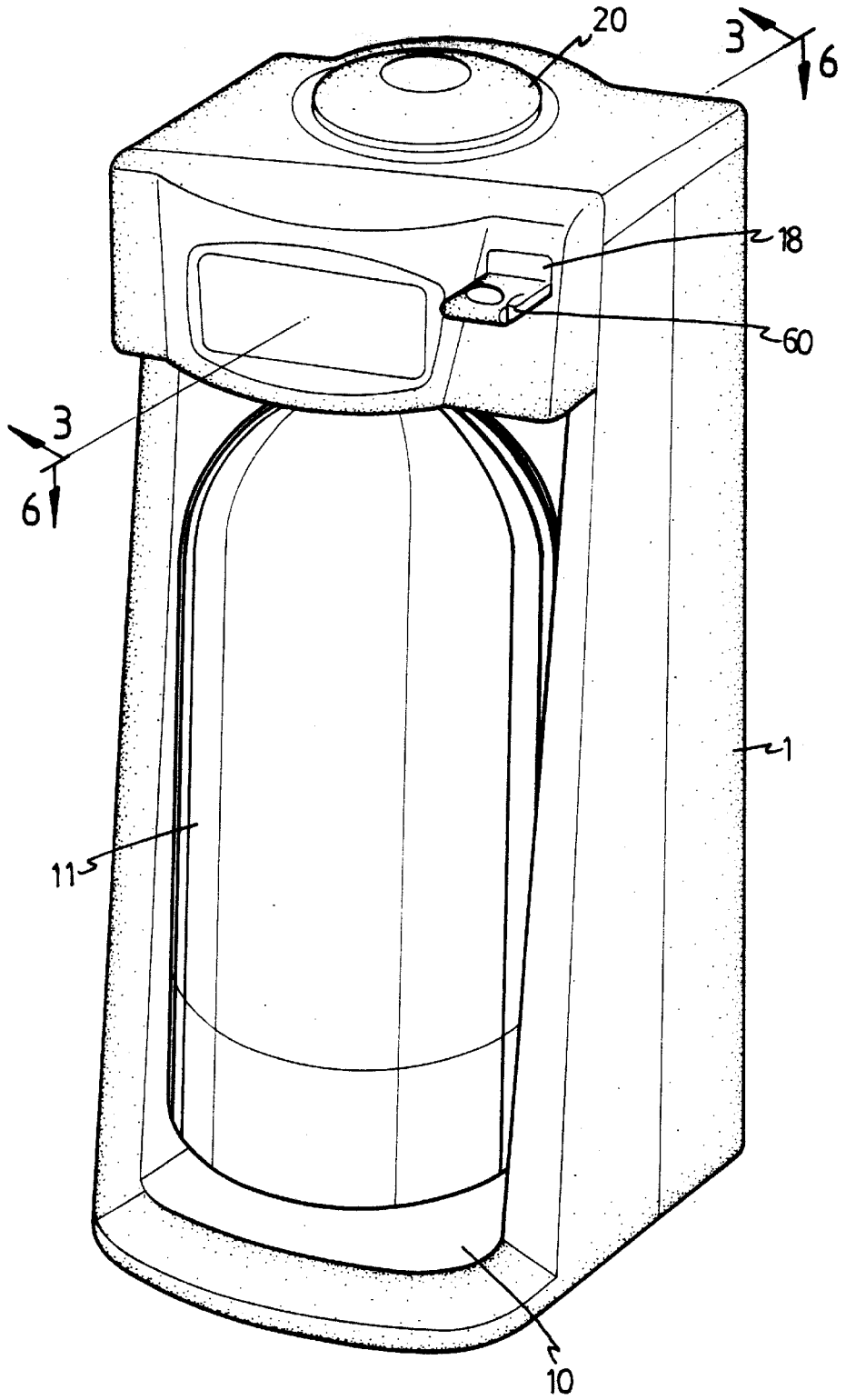
FIG. 1 is a perspective view of a liquid aerating assembly in accordance with the present invention.
Figure 2:
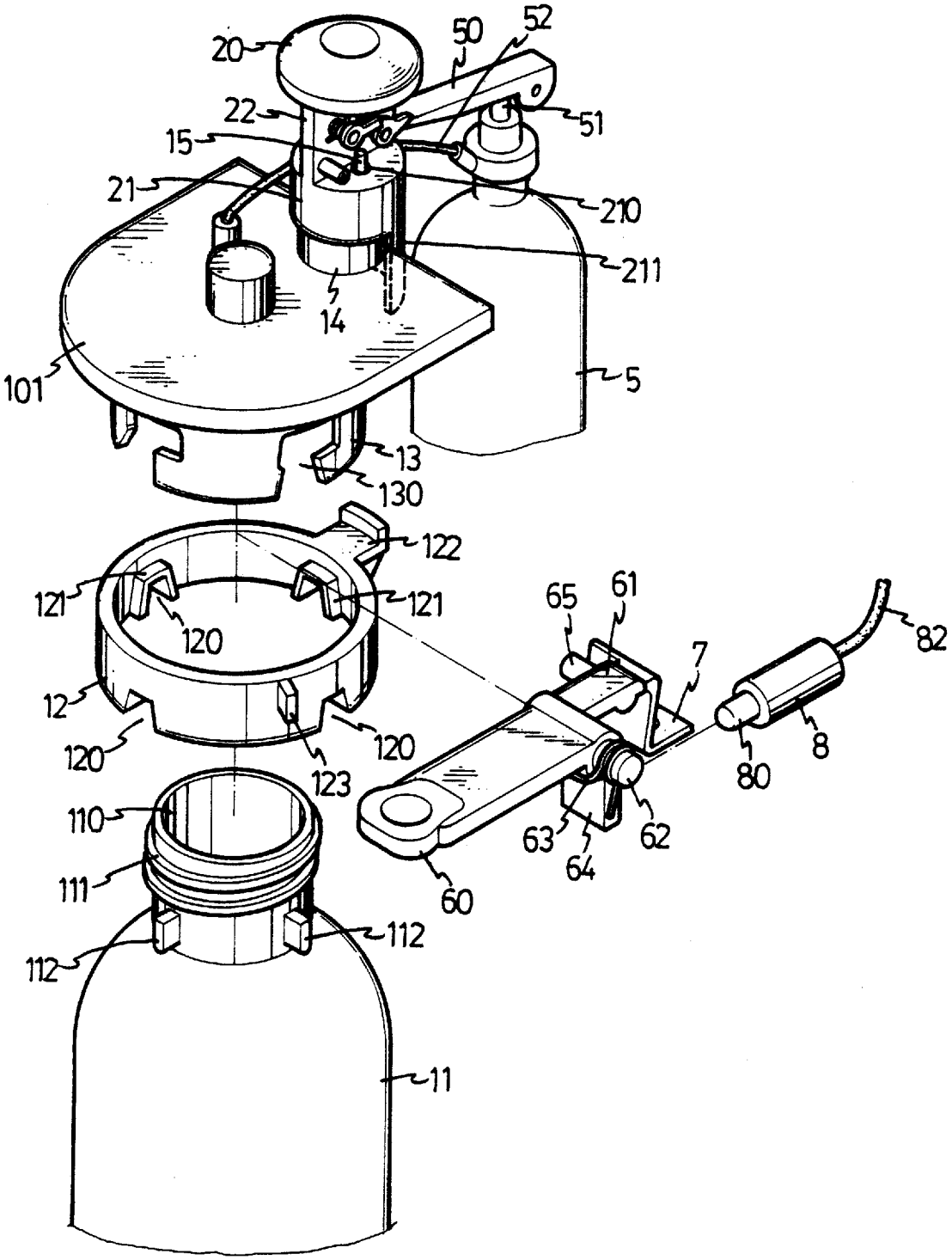
FIG. 2 is a partial exploded view of the liquid aerating assembly.
Figure 3:
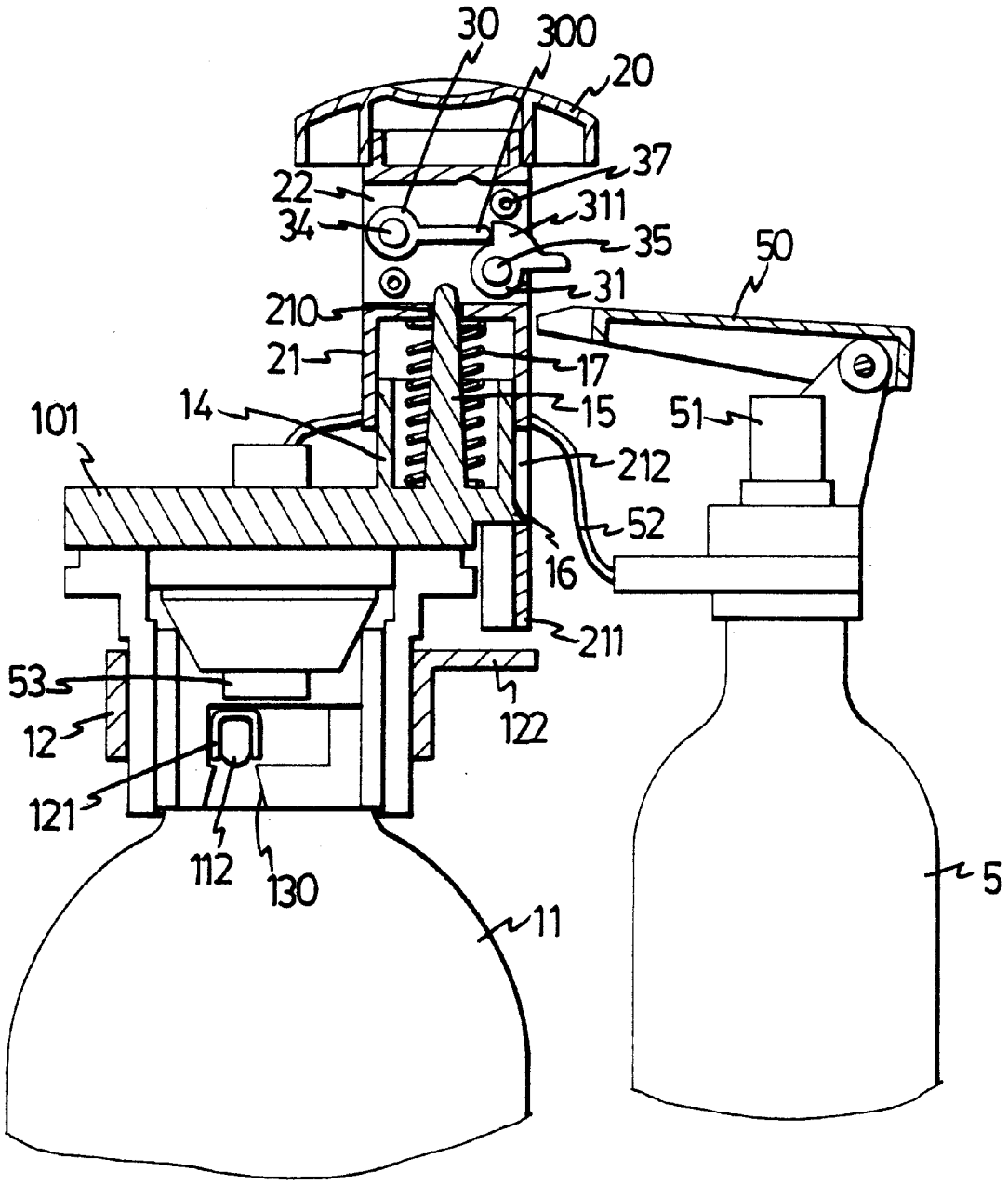
FIG. 3 is a partial cross sectional view taken along lines 3—3 of FIG. 1.

Referring to the drawings, and initially to FIGS. 1–3, a liquid aerating assembly in accordance with the present invention comprises a housing 1 including a chamber 10 for receiving a container 11 which receives the liquid that is to be filled with the pressurized gas, particularly the carbon dioxide. A bottle 5 (FIG. 3) is disposed in the housing 1 for receiving the pressurized gas and for supplying the pressurized gas into the container 11. The bottle 5 includes a button 51 provided on top and a lever 50 pivotally coupled to the upper portion of the bottle 5 for actuating the button 51 and for allowing the pressurized gas to flow out of the bottle 5. The housing 1 includes an opening 18 formed in the upper and front portion for receiving a handle 60 and includes a knob 20 slidably engaged in the upper portion. The housing 1 includes a plate 101 provided in the upper portion.

As best shown in FIGS. 2 and 3, the container 11 includes a mouth 110 having an outer thread 111 provided on the outer peripheral portion and includes one or more protrusions 112 extended radially outward from the outer peripheral portion. A ring 12 is engaged around the mouth 110 and includes one or more notches 120 for engaging with the protrusions 112 of the container 11 and includes one or more inverted U-shaped frames 121 for engaging with the protrusions 112 and for allowing the ring 12 to be rotated in concert with the container 11. The ring 12 includes a projection 123 and an arm 122 extended outward. The plate 101 includes a cylindrical member 13 extended downward and engaged between the mouth 110 of the container 11 and the ring 12. The cylindrical member 13 includes one or more L-shaped retaining channels 130 for force-fittedly engaging with the frames 121 and/or the protrusions 112 (FIG. 4) and for allowing the mouth 110 and the ring 12 to be solidly secured to the plate 101. It is to be noted that, without the frames 121, the protrusions 112 may also be directly engaged with the channels 130 for securing the mouth 110 and the ring 12 to the plate 101. A nozzle 53 is secured in the plate 101 and engaged with the mouth 110 and coupled to the bottle 5 with a hose 52 for supplying the pressurized gas into the container 11.

Figure 6:
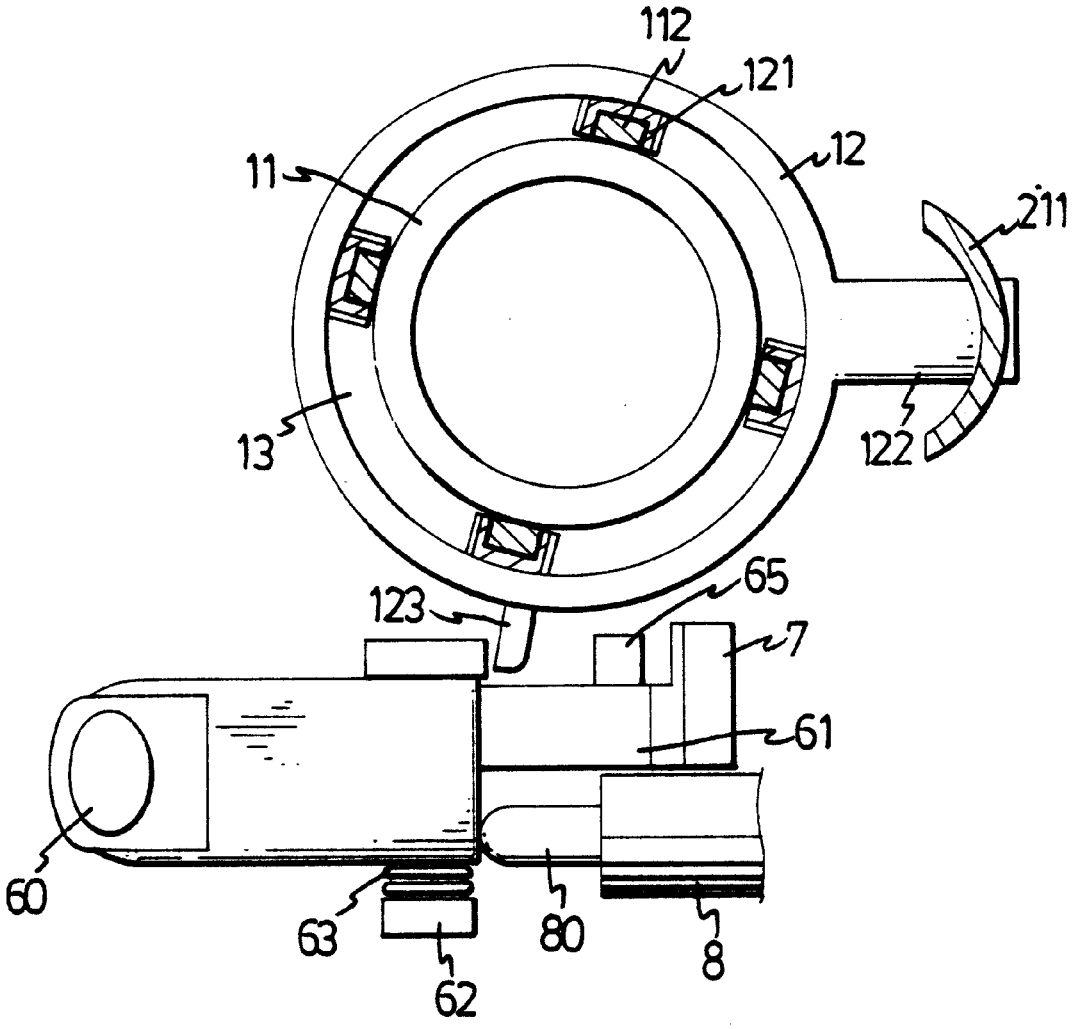
FIG. 6 is a partial cross sectional view taken along lines 6—6 of FIG. 1.

The plate 101 includes a hub 14 extended upward and a pole 15 extended upward from the hub 14 and extended upward beyond the hub 14. A barrel 21 is slidably engaged on the hub 14 and includes a hole 210 for engaging with the pole 15 and for allowing the pole 15 to be extended upward beyond the barrel 21. A spring 17 is engaged between the barrel 21 and the plate 101 for biasing the barrel 21 upward. A panel 22 is extended upward from the barrel 21. The knob 20 is secured on top of the panel 22 for depressing the barrel 21 downward against the spring 17. The barrel 21 includes an extension 211 extended downward for engaging with the arm 122 of the ring 12 (FIGS. 3, 6). The extension 211 includes a slot 212 for slidably engaging with a guide 16 of the plate 101 and for limiting the upward movement of the barrel 21 relative to the plate 101. As shown in FIGS. 3 and 6, the arm 122 will be located below the extension 211 of the barrel 21 before the protrusions 112 and/or the frames 121 are engaged into the channels 130. At this moment, the arm 122 may prevent the barrel 21 from being depressed downward against the spring 17. However, as shown in FIGS. 4 and 7, when the protrusions 112 and/or the frames 121 are engaged into the channels 130, the arm 122 will be disengaged from the extension 211 of the barrel 21 such that the barrel 21 may be depressed downward against the spring 17 at this moment.

Figure 4:
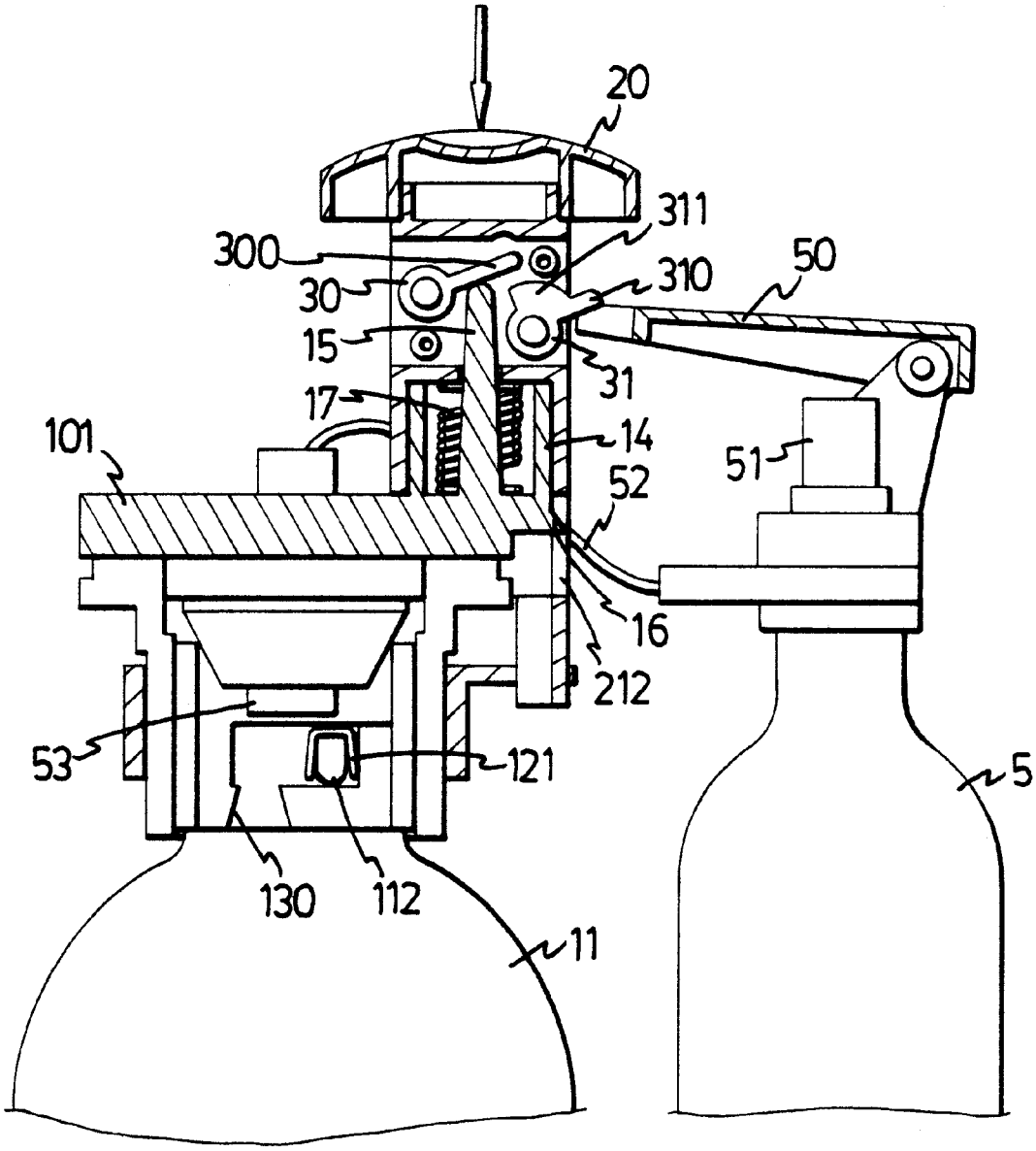
FIG. 4 is a partial cross sectional view similar to FIG. 3, illustrating the operation of the liquid aerating assembly.
Figure 5:
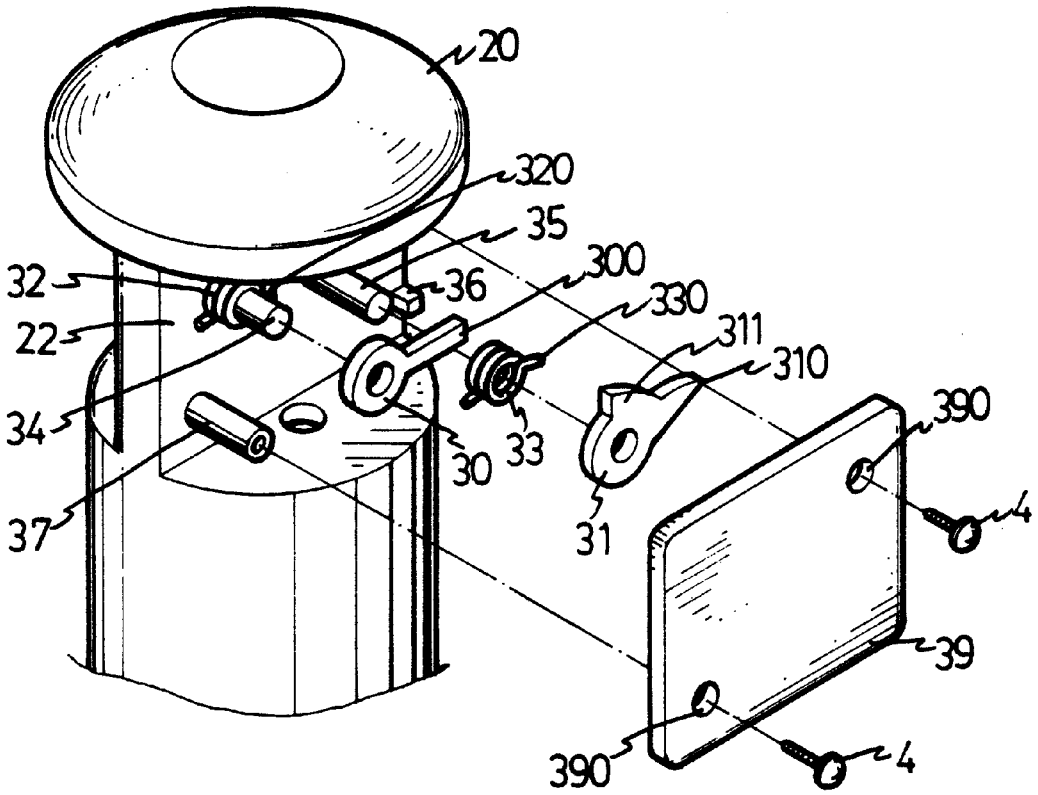
FIG. 5 is a partial exploded view showing the safety device of the liquid aerating assembly.

As shown in FIGS. 2–5, the panel 22 includes two pins 34, 35 and one or more studs 37 and a bulge 36 (FIG. 5). A stop 30 is rotatably secured on the pin 34 and includes a free end 300. A pawl 31 is rotatably engaged on the pin 35 and includes a swelling 311 for engaging with the free end 300 of the stop 30 and includes a portion 310 for actuating the lever 50 (FIGS. 3, 4). Two springs 32, 33 each includes an end portion 320, 330 for engaging with the stop 30 and the pawl 31 and for biasing the pawl 31 clockwise to engage with the lever 50 and for biasing the stop 30 to engage with the swelling 311 of the pawl 31 (FIG. 3). The pawl 31 may thus be prevented from being rotated counterclockwise. At this moment, when the panel 22 is depressed downward against the spring 17 by the knob 20, the pawl 31 may be caused to actuate the lever 50 in order to actuate the button 51 and to supply the pressurized gas into the container 11. When the knob 20 is depressed downward until the pole 15 disengages the stop 30 from the pawl 31 (FIG. 4), the lever 50 may no longer be actuated by the pawl 31. Accordingly, each time when the knob 20 is depressed against the spring 17, the pawl 31 may be caused to depress the lever 50 and to actuate the button 51 for only a short interval before the stop 30 is disengaged from the pawl 31. The button 51 may thus be prevented from being actuated for a long time in order to prevent the container 11 from being overpressurized. The bulge 36 may engage with the pawl 31 for limiting the rotational movement of the pawl 31. A board 39 includes one or more holes 390 for engaging with one or more fasteners 4 which may be engaged with the studs 37 for shielding the stop 30 and the pawl 31.

Figure 7:
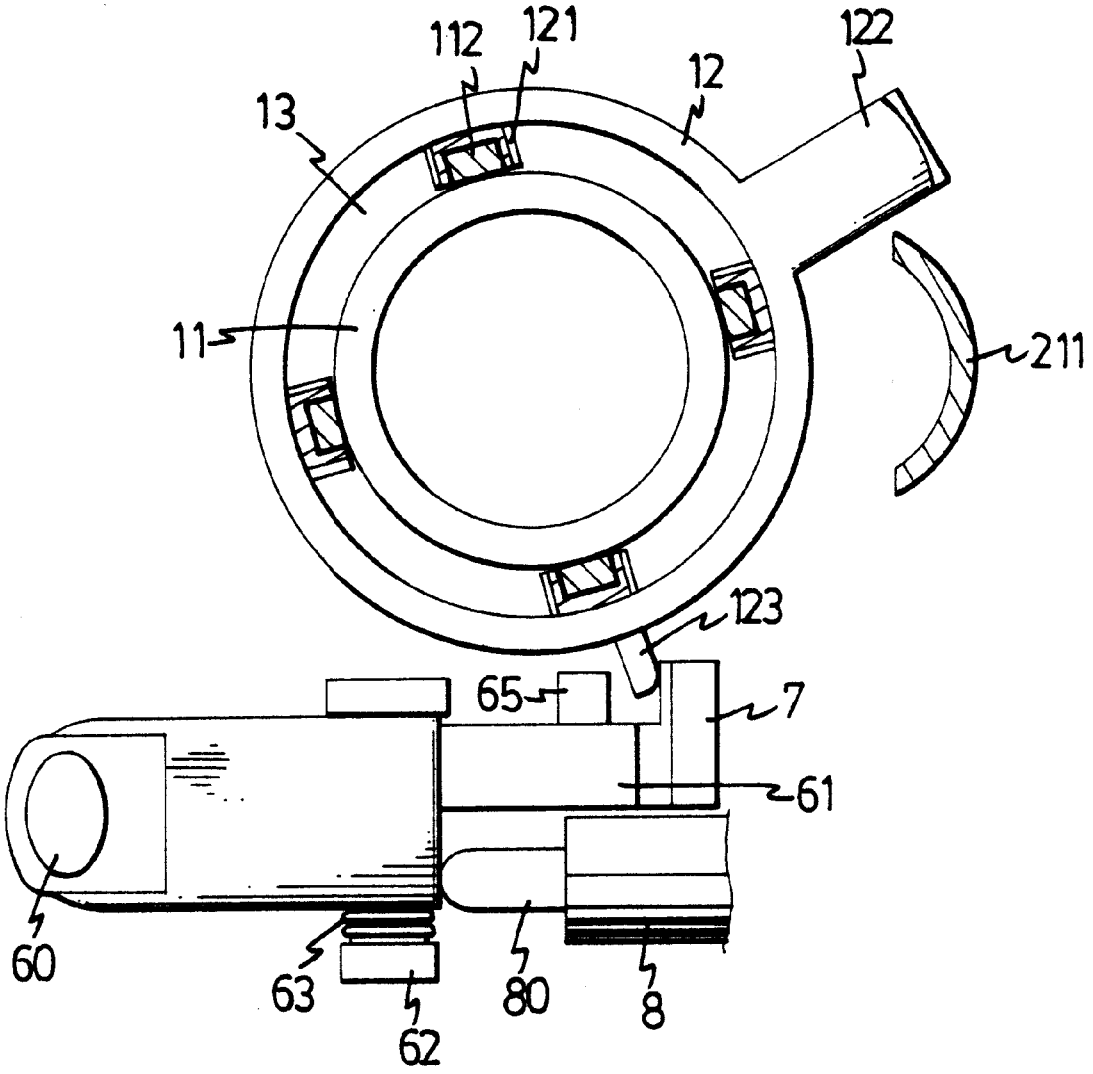
FIG. 7 is a partial cross sectional view similar to FIG. 6, illustrating the operation of the liquid aerating assembly.
Figure 8:
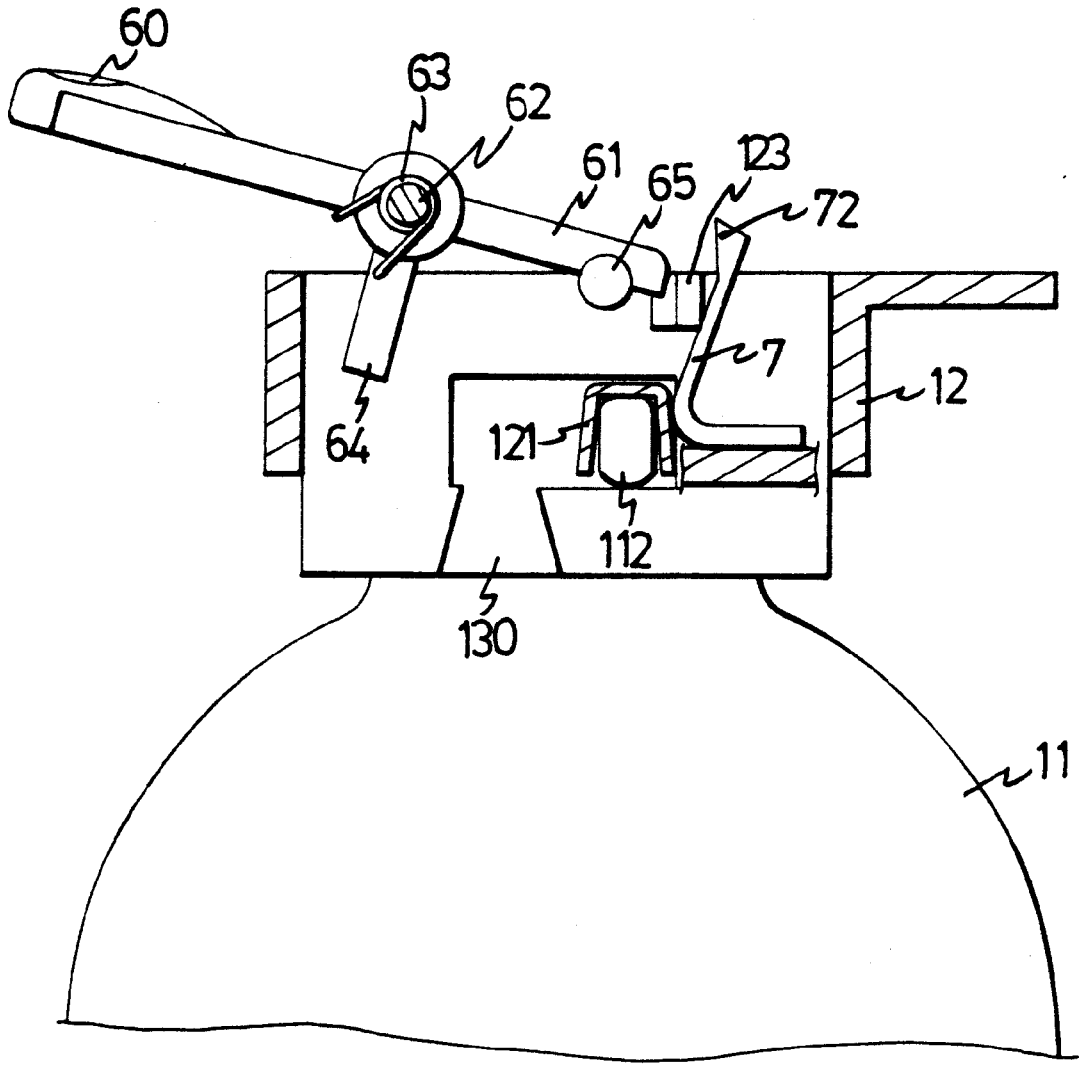
FIGS. 8 and 9 are schematic views illustrating the operation of the liquid aerating assembly.
Figure 9:
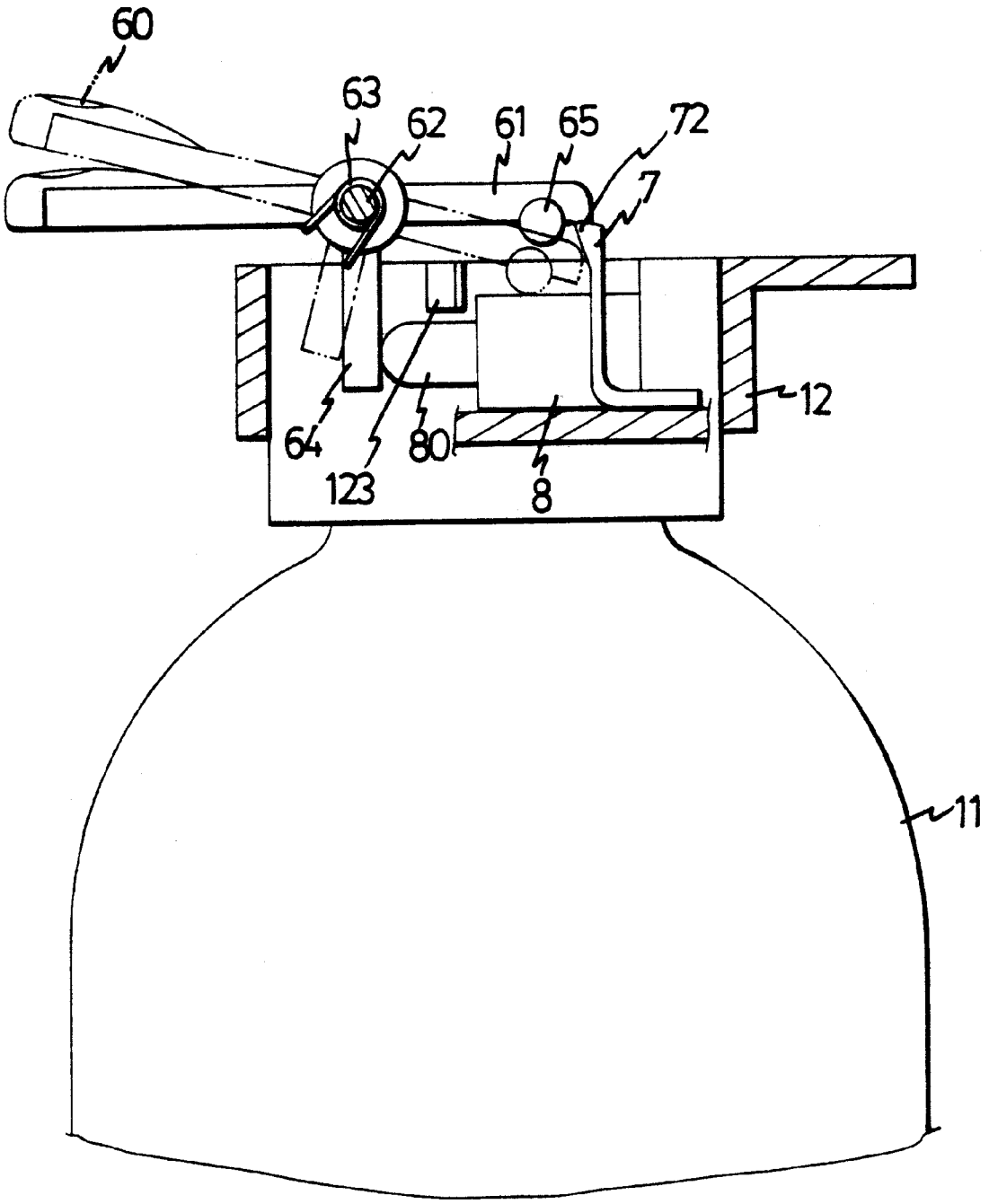

As shown in FIGS. 2 and 6–9, after the liquid aerating procedure is completed, a great pressure will be built up in the mouth 110 of the container 11. A relief valve 8 includes a switch 80 and is coupled to the nozzle 53 for relieving the pressure built in the container 11. A retainer 7 is secured in the housing 1. The handle 60 is pivotally secured in the housing 1 at a shaft 62 and includes a leg 61 extended rearward for engaging with the retainer 7 and includes an actuator 64 extended downward for actuating the switch 80 of the relief valve 8. A spring 63 is engaged on the shaft 62 and engaged with the handle 60 for disengaging the actuator 64 from the switch 80 of the relief valve 8 (FIG. 8). The retainer 7 includes a head 72 for engaging with the leg 51 (FIGS. 8 and 9). When the handle 60 is depressed to disengage the leg 61 from the head 72 of the retainer 7, the actuator 64 may be caused to actuate the switch 80 in order to relieve the pressure in the container 11, such that the container 11 may be easily removed from the housing 1 after the liquid aerating procedure.

As shown in FIGS. 7 and 8, the projection 123 may engage with the retainer 7 for allowing the leg 61 to be engaged with the head 72 of the retainer 7 after the ring 12 and the container 11 are secured to the housing 1 and after the arm 122 is disengaged from the extension 211. The spring 63 may bias the leg 61 to engage with the head 72. The leg 61 includes a jut 65 for engaging with the projection 123 after the projection 123 is engaged with the retainer 7, such that the projection 123 and thus the ring 12 may be prevented from rotating relative to the housing 1 and such that the container 11 may be prevented from disengaging from the housing 1 inadvertently.

Accordingly, the liquid aerating assembly in accordance with the present invention includes a ring 12 for solidly securing the container 11 to the housing 1. The ring 12 includes an arm 122 for engaging with the extension 211 and for preventing the knob 20 from being depressed before the container 11 is secured in place. The provision of the stop 30 and the pawl 31 allows the lever 50 to be actuated for only a short interval in order to prevent the container 11 from being over pressurized. The engagement of the projection 123 with the retainer 7 may prevent the relief valve 8 from being actuated before the container 11 is secured in place. The jut 65 of the leg 61 may engage with the projection 123 and may solidly retain the container 11 in place.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A liquid aerating assembly comprising:

a housing including a chamber, a container engaged in said chamber of said housing and including a mouth, a ring engaged on said mouth of said container for securing said container to said housing, and means for supplying pressurized gas into said container, said mouth of said container including an outer peripheral portion having at least one protrusion extended outward, said ring including at least one notch for engaging with said at least one protrusion.

2. The liquid aerating assembly according to claim 1, wherein said housing includes a plate having a cylindrical member extended downward for engaging between said mouth and said ring, said cylindrical member includes at least one channel for engaging with said at least one protrusion for securing said container and said ring to said housing.

3. The liquid aerating assembly according to claim 2, wherein said ring includes at least one frame for engaging with said at least one protrusion and said at least one channel and for securing said container to said housing.

4. A liquid aerating assembly comprising:

a housing including a chamber, a container engaged in said chamber of said housing and including a mouth, a ring engaged on said mouth of said container for securing said container to said housing, and means for supplying pressurized gas into said container, said ring including an arm extended radially outward for engaging with said pressurized gas supplying means and for disabling said pressurized gas supplying means before said container and said ring are secured to said housing.

* * * * *